US009241543B1

(12) United States Patent
Peng

(10) Patent No.: US 9,241,543 B1
(45) Date of Patent: Jan. 26, 2016

(54) ADJUSTABLE BELT BUCKLE

(71) Applicant: I-Sin Peng, Taichung (TW)

(72) Inventor: I-Sin Peng, Taichung (TW)

(73) Assignee: I-Sin Peng, Taichung (TW)

( * ) Notice: Subject to any disclaimer, the term of this patent is extended or adjusted under 35 U.S.C. 154(b) by 0 days.

(21) Appl. No.: 14/592,927

(22) Filed: Jan. 9, 2015

(51) Int. Cl.
*A44B 11/00* (2006.01)
*A44B 11/12* (2006.01)

(52) U.S. Cl.
CPC ..... *A44B 11/008* (2013.01); *A44B 11/12* (2013.01)

(58) Field of Classification Search
CPC ..... A44B 11/12; A44B 11/065; A44B 11/08; Y10T 24/4072; Y10T 24/202; Y10T 24/4019; Y10T 24/4079; Y10T 24/44376; Y10T 24/44564; A01K 27/001; A01K 27/005; A41F 1/008; F16G 11/10; Y10S 24/48
USPC ..... 24/170, 191, 171, 194, 196, 334, 24/587.12, 641
See application file for complete search history.

(56) References Cited

U.S. PATENT DOCUMENTS 3,344,486 A * 10/1967 Eveland et al. ..... A44B 11/08 24/171
3,900,923 A * 8/1975 Thomas ..... B65D 63/1072 24/16 PB
4,727,630 A * 3/1988 Alan ..... A44B 11/06 24/593.11
4,866,819 A * 9/1989 Kasai ..... A44B 11/263 24/614
5,572,747 A * 11/1996 Cheng ..... A44B 11/12 2/312
5,774,953 A * 7/1998 Mao ..... A44B 11/2592 24/170
6,219,889 B1 * 4/2001 Lovato ..... A44B 11/12 24/170
6,457,210 B1 * 10/2002 Shirai ..... A41F 1/008 24/16 PB
6,715,449 B1 * 4/2004 Jordan ..... A01K 27/005 119/863
7,246,383 B2 * 7/2007 Musal ..... A42B 3/145 2/418
8,522,728 B2 * 9/2013 Davis, Jr. ..... A01K 27/001 119/863
2002/0189056 A1 * 12/2002 Gallina ..... A44B 11/12 24/68 R
2003/0037417 A1 * 2/2003 Shen ..... F16G 11/10 24/334
2004/0154139 A1 * 8/2004 Crook ..... B65D 63/1018 24/16 PB
2010/0175232 A1 * 7/2010 Shirai ..... A41F 1/008 24/641
2012/0297591 A1 * 11/2012 Bozzetto ..... A43C 11/146 24/68 SK
2013/0008056 A1 * 1/2013 Vincent ..... A43B 5/04 36/117.1
2013/0180085 A1 * 7/2013 Chang ..... A44B 11/12 24/191

* cited by examiner

*Primary Examiner* — Robert J Sandy
*Assistant Examiner* — David Upchurch
(74) *Attorney, Agent, or Firm* — Yuwen Guo

(57) ABSTRACT

An adjustable belt buckle is convenient to assembly and makes a binding belt easy to be adjusted. It uses the axial section of the top wall of the main body to further press and limit the pressing member and enhance the engagement between the first teeth portion and the second teeth portion to prevent the second teeth portion from being damaged and increase its life time.

3 Claims, 7 Drawing Sheets

ADJUSTABLE BELT BUCKLE

FIELD OF THE INVENTION

The present invention relates to a buckle, and more particularly to an adjustable belt buckle.

BACKGROUND OF THE INVENTION

Please reference to FIGS. 6 and 7, the conventional adjustable belt buckle 200 is illustrated. A binding belt 230 is passed through a main body 210 and a single-tooth portion 220 arranged inside the main body 210 may be engaged with a multi-teeth portion 240 of the binding belt 240.

However, the conventional adjustable belt buckle 200 only uses the single-tooth portion 220 to engage with the multi-teeth portion 230. The engagement between the single-tooth portion 220 and the multi-teeth portion 240 is week. It is easy to result in the damage of the single-tooth portion 220 while forcing the binding belt 230 excessively.

SUMMARY OF THE INVENTION

An objective of this invention is providing an adjustable belt buckle. It may be convenient to assembly and makes the binding belt easy to be adjusted. It uses the axial section of the top wall of the main body to further press and limit the pressing member and enhance the engagement between the first teeth portion and the second teeth portion to prevent the second teeth portion from being damaged and increase its life time.

To achieve above objectives, an adjustable belt buckle is provided. The adjustable belt buckle includes a main body, having a bottom wall, a first side wall, a second side wall, and a top wall, the first side wall and the second side wall are respectively extended upwardly from two sides of the bottom wall in an axial direction, the bottom wall has a front end and a rear end in the axial direction, a first elongated hole is formed at the first side wall in the axial direction, a second elongated hole is formed at the second side wall in the axial direction and corresponding to the first elongated hole, a first limit portion is formed at the first elongated hole adjacent to the rear end of the bottom wall, a second limit portion is formed at the second elongated hole adjacent to the rear end of the bottom wall, the top wall has a transverse section and an axial section connected with each other as a T shape, two ends of the transverse section are respectively connected with a top end of the first side wall and a top end of the second side wall and adjacent to the rear end of the bottom wall, the axial section is extending from a location between two ends of the transverse section toward the front end of the bottom wall so that an U-shaped groove is defined by the top wall, the first side wall, and the second side wall, and a location between the top wall and the bottom wall provides a binding belt to be passed through, and a first teeth portion is formed at an upper surface of the binding belt; and a pressing member, having a shaft, a pressing plate, and a second teeth portion, the pressing plate has a front end and a rear end in the axial direction, the shaft is transversely connected to the rear end of the pressing plate, two ends of the shaft are respectively protruded from two sides of the pressing plate outwardly, the second teeth portion is arranged at a lower surface of the pressing plate, one end of the shaft is passing through the first elongated hole adjacent to the front end of the bottom wall, and the other end of the shaft is passing through the second elongated hole adjacent to the front end of the bottom wall.

Wherein two ends of the shaft are respectively slid along the first elongated hole and the second elongated hole and toward the rear end of the bottom wall till two ends of the shaft are respectively against the first limit portion and the second limit portion, and the pressing plate is pressed by the axial section of the top wall, moved toward the bottom wall, and then located between the top wall and bottom wall so that the second teeth portion and the first teeth portion are one-way engaged.

In some embodiments, the second teeth portion includes at least three teeth.

In some embodiments, the first side wall further has a first sliding groove disposed below the first elongated hole, and the second side wall further has a second sliding groove disposed below the first elongated hole so that the binding belt is movable in the first sliding groove and the second sliding groove forward and backward.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
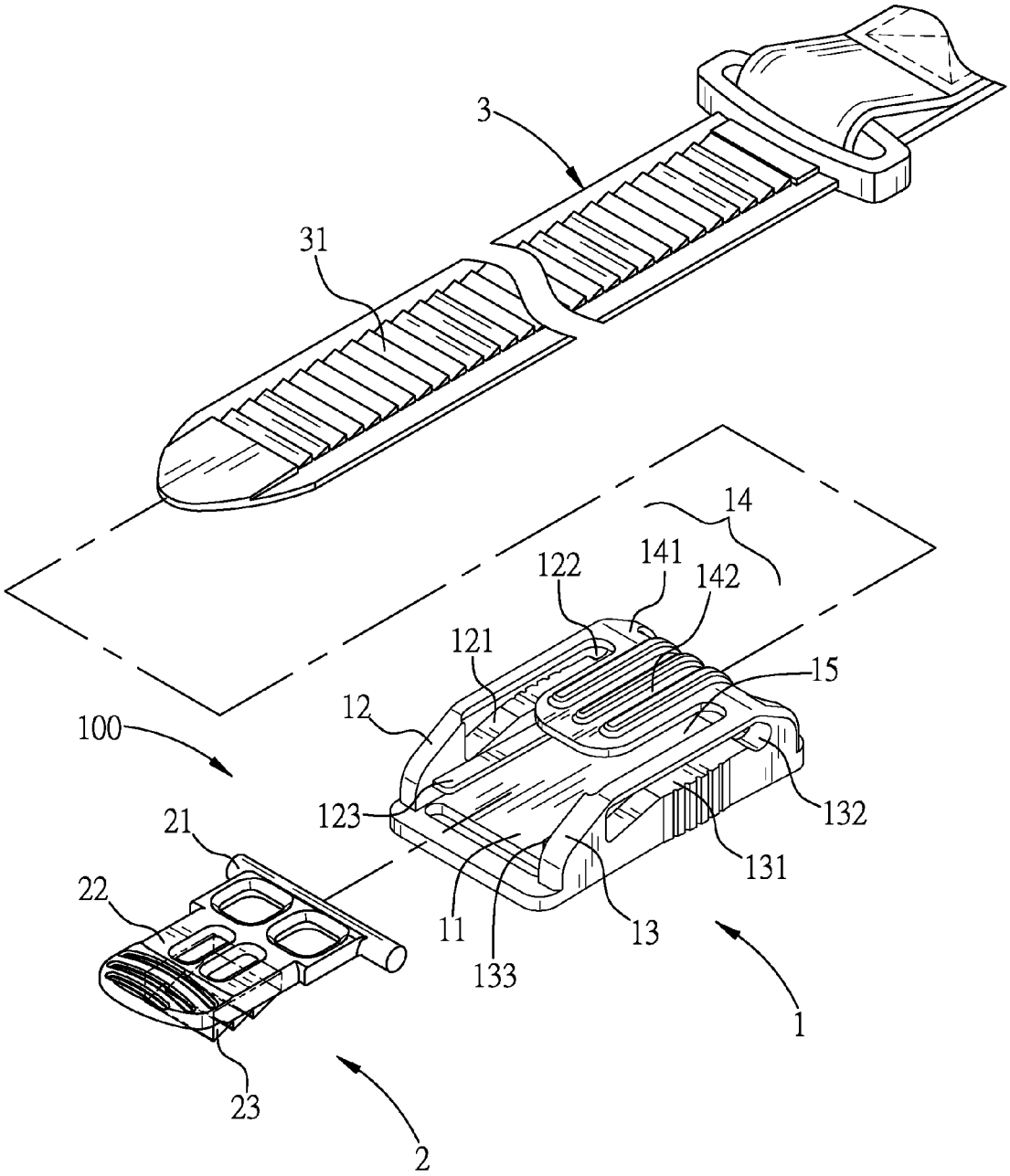
FIG. 1 is an exploded view of an adjustable belt buckle with a binding belt according to this present invention.

Referring now to the drawings where like characteristics and features among the various figures are denoted by like reference characters.

Figure 2:
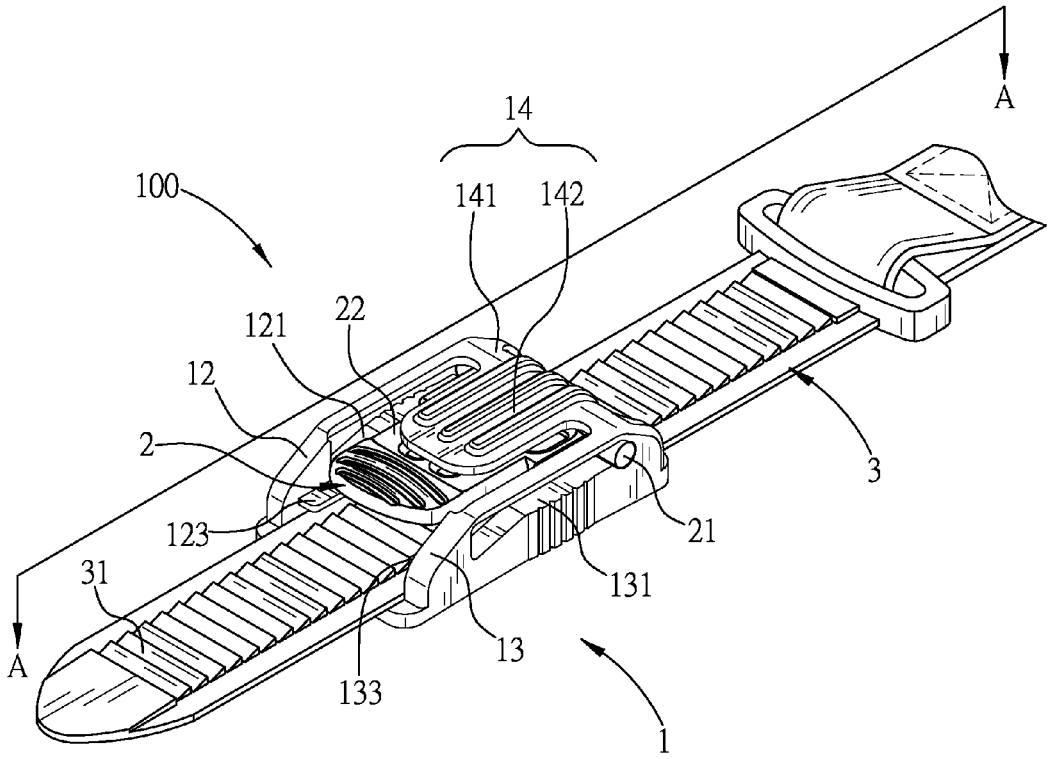
FIG. 2 is an outside view of the adjustable belt buckle with the biding belt according to this present invention.
Figure 3:
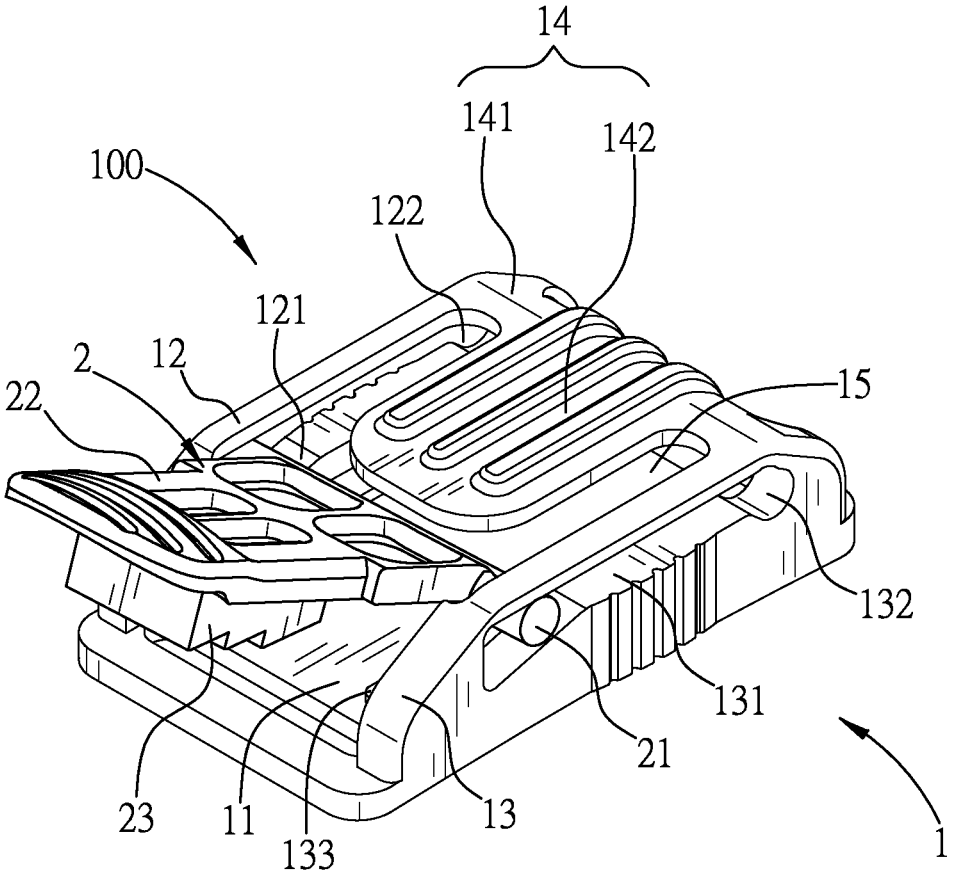
FIG. 3 is an outside view of the adjustable belt buckle according to this present invention.
Figure 4:
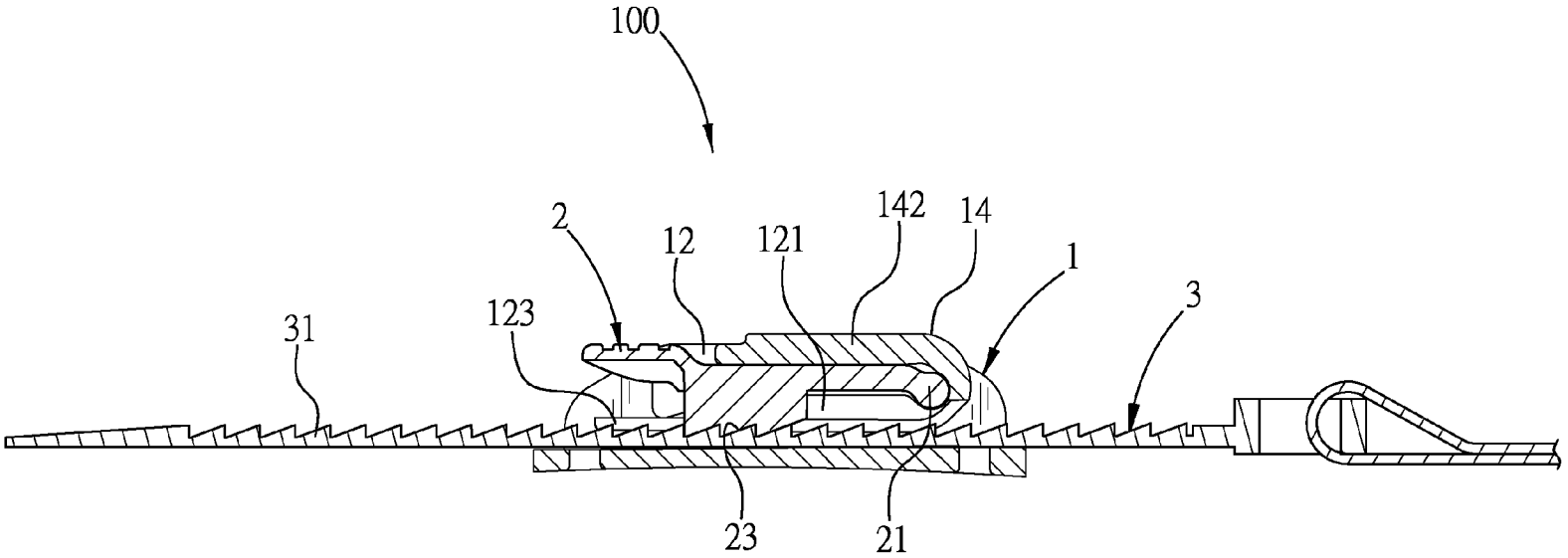
FIG. 4 is a cross-sectional view of FIG. 2 along line A-A while in a fastening status.
Figure 5:
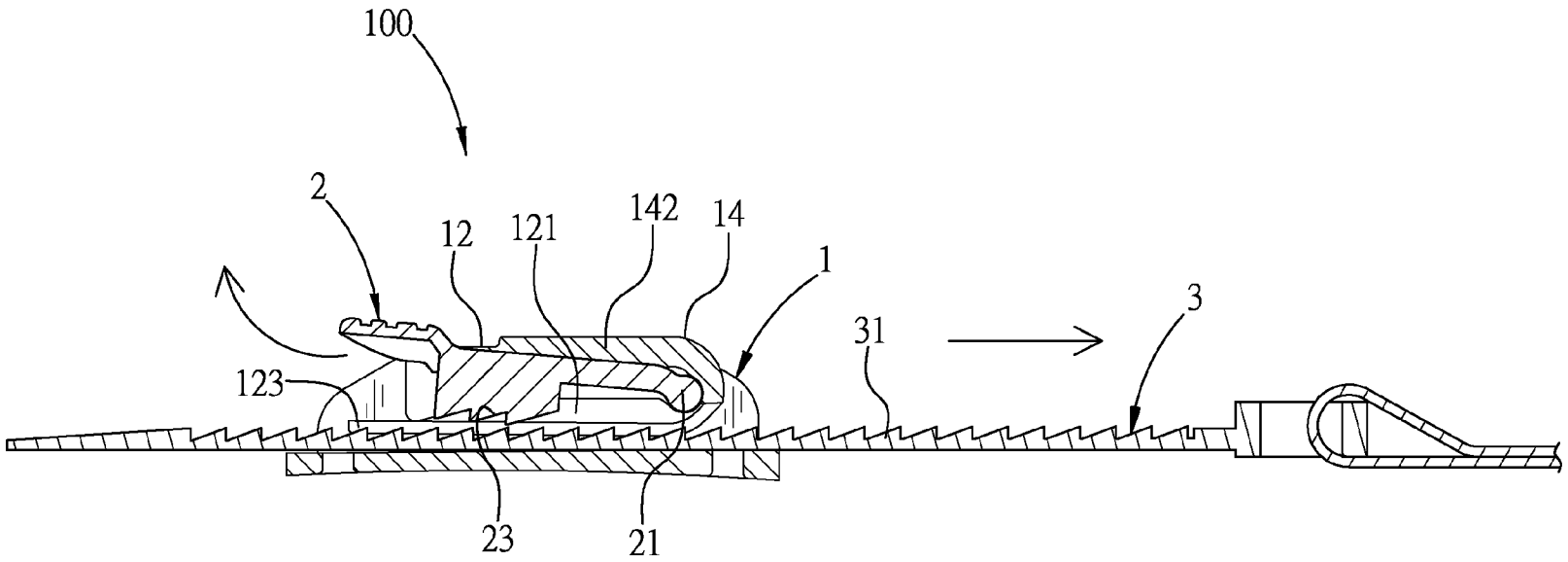
FIG. 5 is a cross-sectional view of FIG. 2 along line A-A while in an adjusting status.
Figure 6:
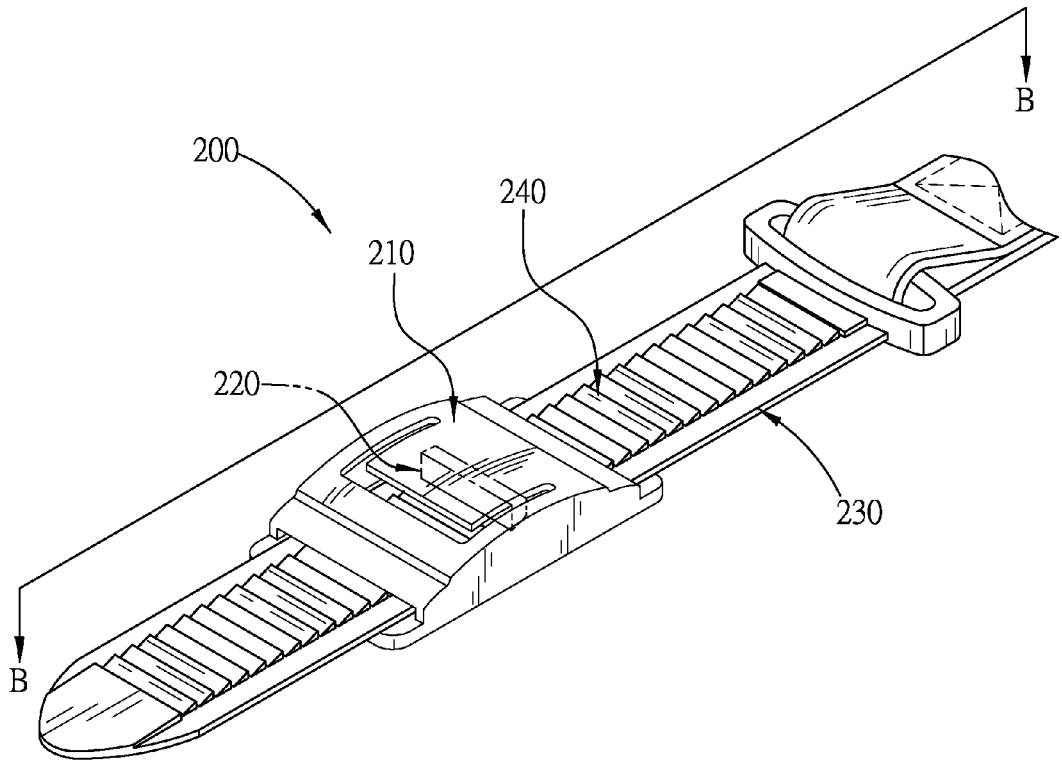
FIG. 6 ( Prior art)
FIG. 6 is a perspective view of a conventional belt buckle which is adjustable and FIG. 7 is a cross-sectional view of FIG. 6 along line B-B.
Figure 7:
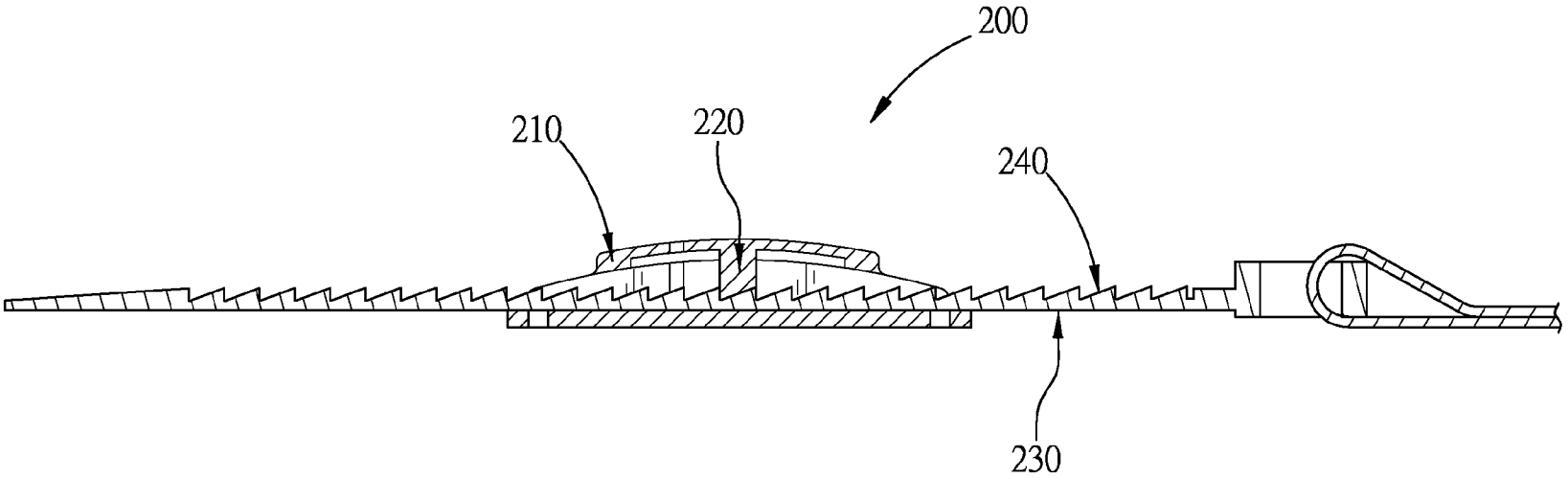
FIG. 7 ( Prior art)

FIG. 1 is an exploded view of an adjustable belt buckle with a binding belt according to this present invention. FIG. 2 is an outside view of the adjustable belt buckle with the biding belt according to this present invention. FIG. 3 is an outside view of the adjustable belt buckle according to this present invention. FIG. 4 is a cross-sectional view of FIG. 2 along line A-A while in a fastening status. FIG. 5 is a cross-sectional view of FIG. 2 along line A-A while in an adjusting status.

Please refer to FIGS. 1 to 5, the adjustable belt buckle 100 of this invention may comprise a main body 1 and a pressing member 2.

The main body 1 may have a bottom wall 11, a first side wall 12, a second side wall 13, and a top wall 14. The first side wall 12 and the second side wall 13 are respectively extended upwardly from two sides of the bottom wall 11 in an axial direction. The bottom wall 22 has a front end and a rear end in the axial direction. A first elongated hole 121 is formed at the first side wall 12 in the axial direction. A second elongated hole 131 is formed at the second side wall 13 in the axial direction and corresponding to the first elongated hole 121. A first limit portion 122 is formed at the first elongated hole 121 adjacent to the rear end of the bottom wall 11. A second limit portion 132 is formed at the second elongated hole 131 adjacent to the rear end of the bottom wall 11. The top wall 14 has a transverse section 141 and an axial section 142 connected with each other as a T shape. Two ends of the transverse section 141 are respectively connected with a top end of the first side wall 12 and a top end of the second side wall 13 and adjacent to the rear end of the bottom wall 11. The axial section 142 is extending from a location between two ends of the transverse section 141 toward the front end of the bottom wall 11 so that an U-shaped groove 15 is defined by the top wall 14, the first side wall 12, and the second side wall 13. And a location between the top wall 14 and the bottom wall 11 may provide a binding belt 3 to be passed through. In addition, a first teeth portion 31 may be formed at an upper surface of the binding belt 3.

Furthermore, the first side wall 12 may further have a first sliding groove 123 disposed below the first elongated hole 121. And the second side wall 13 may further have a second sliding groove 133 disposed below the first elongated hole 131 so that the binding belt 3 may be movable in the first sliding groove 123 and the second sliding groove 133 forward and backward.

The pressing member 2 may have a shaft 21, a pressing plate 22, and a second teeth portion 23. The pressing plate 22 has a front end and a rear end in the axial direction. The shaft 21 is transversely connected to the rear end of the pressing plate 22. Two ends of the shaft 21 are respectively protruded from two sides of the pressing plate 22 outwardly. The second teeth portion 23 may be arranged at a lower surface of the pressing plate 22 and may have at least three teeth, but not limited thereto. One end of the shaft 21 is passing through the first elongated hole 121 adjacent to the front end of the bottom wall 11, and the other end of the shaft 21 is passing through the second elongated hole 131 adjacent to the front end of the bottom wall 11.

And then, two ends of the shaft 21 may be respectively slid along the first elongated hole 121 and the second elongated hole 131 and toward the rear end of the bottom wall 11 till two ends of the shaft 21 are respectively against the first limit portion 122 and the second limit portion 132. And the pressing plate 22 is pressed by the axial section 142 of the top wall 14, moved toward the bottom wall 11, and then located between the top wall 14 and bottom wall 11 so that the second teeth portion 23 and the first teeth portion 31 are one-way engaged.

When two ends of the shaft 21 of pressing member 2 respectively protruded from two sides of the pressing plate 22 in the axial direction are respectively stopped at the first limit portion 122 and the second limit portion, the pressing member 2 is against and pressed toward the binding belt 3 by the axial section 142 of the top wall 14 and the binding belt 3 may be slid at the location between the first sliding groove 123 and the second sliding groove 144 and toward the front end of the bottom wall 11. If the binding belt 3 is forced toward the rear end of the bottom wall 11, the first teeth portion 31 of the binding belt 3 may be pressed and limited by the second teeth portion 23.

When the binding belt 3 is forced toward the rear end of the bottom wall 11 to be adjusted, the front end of the pressing plate 22 of the pressing member 2 may be pushed upwardly and then the axial section 142 of the top wall 14 may be moved upwardly at the same time so that the second teeth portion 23 may be removed from the first teeth portion 21 and then the binding belt 3 may be moved freely.

Therefore, the adjustable belt buckle of this invention is convenient to assembly and makes the binding belt 3 easy to be adjusted. It uses the axial section 142 of the top wall 14 of the main body 1 to further press and limit the pressing member 2 and enhance the engagement between the first teeth portion 31 and the second teeth portion 23 to prevent the second teeth portion 23 from being damaged and increase its life time.

What is claimed is:

1. An adjustable belt buckle, comprising:

a main body, having a bottom wall, a first side wall, a second side wall, and a top wall, the first side wall and the second side wall are respectively extended upwardly from two sides of the bottom wall in an axial direction, the bottom wall has a front end and a rear end in the axial direction, a first elongated hole is formed at the first side wall in the axial direction, a second elongated hole is formed at the second side wall in the axial direction and corresponding to the first elongated hole, a first limit portion is formed at the first elongated hole adjacent to the rear end of the bottom wall, a second limit portion is formed at the second elongated hole adjacent to the rear end of the bottom wall, the top wall has a transverse section and an axial section connected with each other as a T shape, two ends of the transverse section are respectively connected with a top end of the first side wall and a top end of the second sidewall and adjacent to the rear end of the bottom wall, the axial section is extending from a location between two ends of the transverse section toward the front end of the bottom wall so that an U-shaped groove is defined by the top wall, the first side wall, and the second side wall, and a location between the top wall and the bottom wall provides a binding belt to be passed through, and a first teeth portion is formed at an upper surface of the binding belt; and a pressing member, having a shaft, a pressing plate, and a second teeth portion, the pressing plate has a front end and a rear end in the axial direction, the shaft is transversely connected to the rear end of the pressing plate, two ends of the shaft are respectively protruded from two sides of the pressing plate outwardly, the second teeth portion is arranged at a lower surface of the pressing plate, one end of the shaft is passing through the first elongated hole adjacent to the front end of the bottom wall, and the other end of the shaft is passing through the second elongated hole adjacent to the front end of the bottom wall;

wherein two ends of the shaft are respectively slid along the first elongated hole and the second elongated hole and toward the rear end of the bottom wall till two ends of the shaft are respectively against the first limit portion and the second limit portion, and the pressing plate is pressed by the axial section of the top wall, moved toward the bottom wall, and then located between the top wall and bottom wall so that the second teeth portion and the first teeth portion are one-way engaged.

2. The adjustable belt buckle as claimed in claim 1, wherein the second teeth portion includes at least three teeth.

3. The adjustable belt buckle as claimed in claim 1, wherein the first side wall further has a first sliding groove disposed below the first elongated hole, and the second side wall further has a second sliding groove disposed below the first elongated hole so that the binding belt is movable in the first sliding groove and the second sliding groove forward and backward.

* * * * *